United States Patent [19]

Sanai et al.

[11] 4,443,276

[45] Apr. 17, 1984

[54] MN—AL—C ALLOYS FOR ANISOTROPIC PERMANENT MAGNETS

[75] Inventors: Susumu Sanai, Hirakata; Kiyoshi Kojima, Katano, both of Japan

[73] Assignee: Matsushita Electric Industrial, Co., Ltd., Osaka, Japan

[21] Appl. No.: 453,955

[22] Filed: Dec. 28, 1982

[30] Foreign Application Priority Data

Jan. 12, 1982 [JP] Japan ..... 57-3918

[51] Int. Cl.[3] ..... H01F 1/04

[52] U.S. Cl. ..... 148/31.57; 420/434

[58] Field of Search ..... 148/31.57, 424; 420/434

[56] References Cited

U.S. PATENT DOCUMENTS

| | | | |
|---|---|---|---|
| 3,976,519 | 8/1976 | Kubo et al. | 148/31.57 |
| 4,023,991 | 5/1977 | Kubo et al. | 148/31.57 |
| 4,055,732 | 10/1977 | Yoshimura et al. | 420/434 |
| 4,133,703 | 1/1979 | Kojima et al. | 148/31.57 |
| 4,312,684 | 1/1982 | Chraplyvy et al. | 148/31.57 |
| 4,342,608 | 8/1982 | Willens | 148/31.57 |

*Primary Examiner*—John P. Sheehan

*Attorney, Agent, or Firm*—Wenderoth, Lind & Ponack

[57] ABSTRACT

A permanent magnetic alloy characterized in that phosphorus of 0.6% or less by weight is added with respect to an Mn—Al—C alloy of 100% by weight comprising manganese of 68.0% to 73.0% by weight, carbon of (1/10)Mn—6.6)% to ($\frac{1}{3}$Mn—22.2)% by weight, and the remainder aluminum.

4 Claims, 7 Drawing Figures

MN—AL—C ALLOYS FOR ANISOTROPIC PERMANENT MAGNETS

BACKGROUND OF THE INVENTION

The present invention relates to a permanent magnet, and more particularly to an anisotropic manganese-aluminum-carbon (Mn—Al—C) permanent magnet, whose magnetic characteristics are improved.

In recent years, an anisotropic Mn—Al—C permanent magnet has been developed, as disclosed within U.S. Pat. No. 3,976,519, which is superior in magnetic characteristics and comprises manganese of 68.0% to 73.0% by weight, carbon of (1/10Mn—6.6)% to (⅓Mn—22.2)% by weight, wherein the Mn in the numerical equation represents the weight % of manganese component, and the remainder aluminum.

The Mn—Al—C alloys for permanent magnets are already used in speakers, electric appliances, etc. In appliances such as motor, generator, etc., wherein demagnetizing field is applied upon the magnet, it is demanded that the coercive force of the magnet should be larger. In the speaker, electric appliance, etc., the maximum energy product (BH)max of the magnet is demanded to be greater due to tendency towards the smaller size.

SUMMARY OF THE INVENTION

Accordingly, an object of the present invention is to provide a Mn—Al—C alloy for the anisotropic permanent magnet whose magnetic characteristics are improved. In detail, in the composition of the alloy magnet of the present invention, phosphorus of X% by weight is added to the conventional Mn—Al—C alloy in amounts such that X has the value $0<X\leqq 0.6$, said alloy comprising manganese of 68.0% to 73.0% by weight, carbon of (1/10Mn—6.6)% to (⅓Mn—22.2)% by weight, and the remainder aluminum. The Mn—Al—C alloy for the anisotropic permanent magnet is made by the warm plastic deformation of the alloy. The alloy magnet of the present invention can be considerably improved particularly in coercive force and maximum energy product (BH)max as compared with the magnetic characteristics of the conventional Mn—Al—C alloy used for an anisotropic permanent magnet.

BRIEF DESCRIPTION OF THE DRAWINGS

This and other objects and features of the present invention will become apparent from the following description taken in conjunction with the preferred embodiment thereof with reference to the accompanying drawings, in which.

However, the values of the $_IH_C$, (BH)max of FIG. 3 to FIG. 7 are shown as the ratio of the Mn—Al—C—Ni quaternary alloy with respect to the $_IH_C$, (BH)max.

DETAILED DESCRIPTION OF THE PREFERRED EMBODIMENT

The present invention will be described hereinafter in detail with reference to the following representative experimental data.

The Mn—Al—C—P quaternary alloys wherein various amounts of phosphorus were added to the Mn—Al—C ternary alloy within the range of the composition of manganese of 68.0% to 73.0% by weight, carbon of (1/10Mn—6.6)% to (⅓Mn—22.2)% by weight, and the remainder aluminum, were prepared by melting and casting. Samples each being 18 mm in diameter and 26 mm in length were cut out of the casting. The samples were subjected to a heat treatment for one hour at 1100° C. and thereafter are cooled to room temperature. Then, the samples were extruded at 720° C. by using a die having an extrusion ratio of 6. The magnetic characteristics of the extruded samples were measured along the axial direction of the samples. The extruded samples were anisotropic permanent magnets each having an easy axis along the axial direction of the sample.

Figure 1:
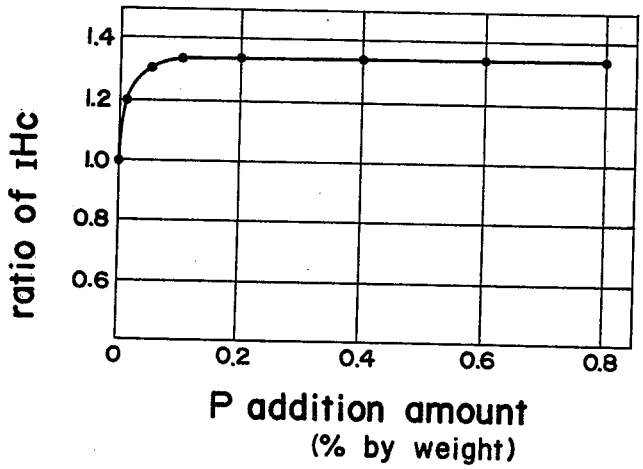
FIG. 1 and FIG. 2 are graphs each showing the relationship between the addition amount of phosphorus (P) and the coercive force $_IH_C$, maximum energy product (BH)max in a case where the phosphorus has been added to the Mn—Al—C ternary alloy, wherein the values of the $_IH_C$, (BH)max are shown as a ratio of the Mn—Al—C ternary alloy with respect to the $_IH_C$, (BH)max.
Figure 2:
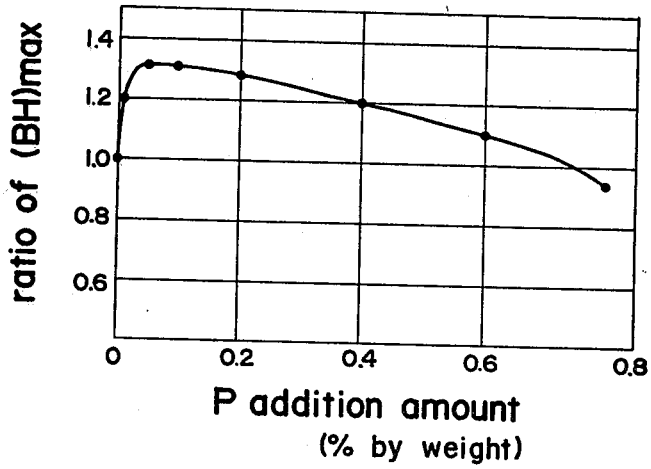

The experimental results, after the extrusion process, of the phosphorus added quaternary alloy are shown in FIG. 1 and FIG. 2. FIG. 1 shows the change in the $_IH_C$ with respect to the phosphorus addition amount, and FIG. 2 shows the change in the (BH)max with respect to the phosphorus addition amount. However, the values of the $_IH_C$ and the (BH)max are shown as a ratio of the Mn—Al—C ternary alloy, which was made under the same conditions, with respect to the $_IH_C$ and the (BH)max.

As shown in FIG. 1, a very small amount of phosphorus of 0.01% by weight was added to improve the $_IH_C$, after the extrusion, by 20% as compared with the Mn—Al—C ternary alloy. Particularly, when $P\geqq 0.05\%$ by weight, the $_IH_C$ is improved by 30% or more. As shown in FIG. 2, the (BH)max was improved by 10% or more in the $0<P\leqq 0.6$ as compared with the Mn—Al—C ternary alloy. Particularly, when phosphorus of 0.05% by weight had been added, the (BH)max improved by 30% or more. As apparent from the above-described experimental data, the effect of adding phosphorus is considerable, particularly in the P region where a small amount is added in respect to the improvement of magnetic characteristics, especially the $_IH_C$, (BH)max values. According to the other experimental results, the $_IH_C$, (BH)max values were recognized to be improved by 16% when phosphorus is added in amounts of 0.005% by weight. The $_IH_C$, (BH)max were recognized to be improved by 6% when phosphorus is added in an amount of 0.001% by weight. From the above description, it can be said that the addition effect of the phosphorus logarithmically appears with respect to the phosphorus addition amount in the region of the phosphorus addition amount of 0.1% or less by weight. Once the amount of the phosphorus exceeds 0.6% by weight, the low-Mn phase (r-AlMn phase) of a non-magnetic phase, and the precipitation of the phosphide increased in the alloy so that the saturated magnetization sharply decreased and the (BH)max also decreased. The r-Almn phase and the precipitation of the phosphide had been confirmed by X-ray diffraction, by an electron probe X-ray micro analysis and by a metallurgical microscope. From the above-description, the effective addition amount of the phosphorus is $0<P\leqq 0.6$.

The cause for improvement in $_IH_C$ by addition of the phosphorus is not yet known. Even if the phosphorus is added the $_IH_C$ is not improved in an isotropic magnet to be provided by the heat treatment, but the $_IH_C$ is improved in the warm-extruded anisotropic magnet by the addition of the phosphorus. And as the considerable influence given by the addition of the phosphorus, the transformation speed from the $\epsilon$ phase (high-temperature phase) to the $\tau$ phase (magnetic phase) becomes slower, when the addition amount of the phosphorus added is more. Judging from the above description, the phosphorus is considered to have an effect of preventing the atom Mn or Al, as a major constituent element, from moving. The effect promotes the grain refining caused by the warm plastic deformation, thus increasing the $_IH_C$.

It was recognized that the magnetic characteristics were further improved by the addition of Ni to the above-described Mn—Al—C—P quaternary alloy.

Figure 3:
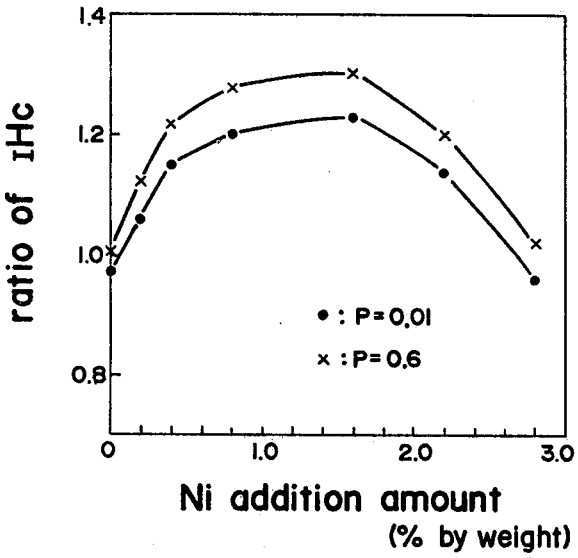
FIG. 3 to FIG. 5 are graphs each showing the relationship between the amount of nickel added and the $_IH_C$, (BH)max in the case where nickel (Ni) has been added to an Mn—Al—C—P quaternary alloy.
Figure 4:
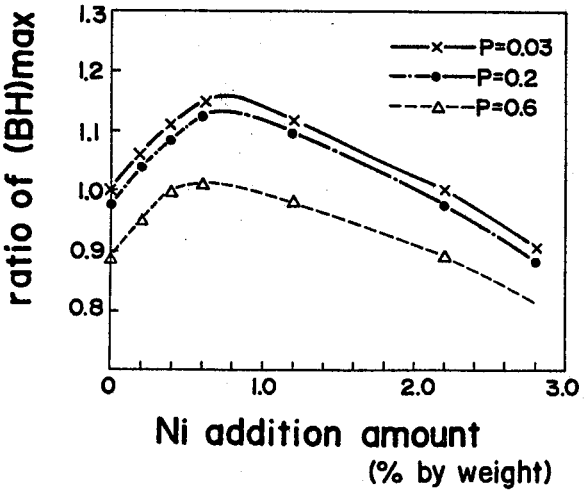
Figure 5:
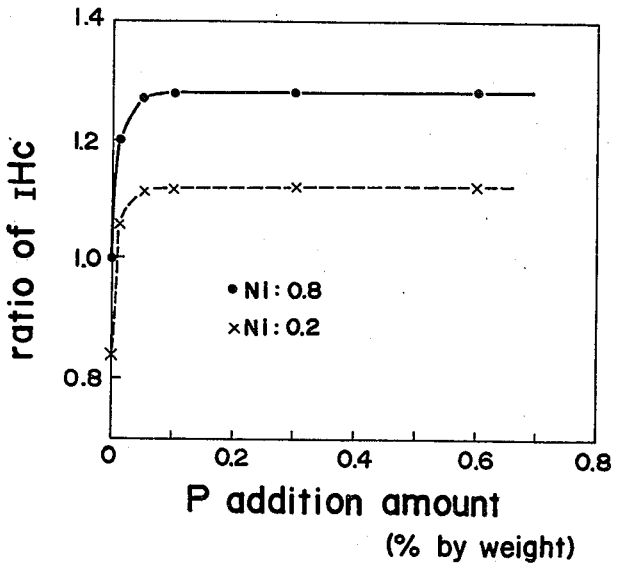

Experiments similar to those made in the phosphorus-added quaternary alloy were made in the Mn—Al—C—P—Ni pentad alloy, wherein the extrusion ratio was 5. The representative experimental results are shown in FIG. 3 to FIG. 5. FIG. 3 to FIG. 5 show variations in the $_IH_C$, (BH)max, after the extrusion, with respect to the nickel addition amount. The values of the $_IH_C$, (BH)max are showed in ratio with respect to the $_IH_C$, (BH)max of the Mn—Al—C—Ni quaternary alloy (Ni=0.8% by weight) made under the same conditions. As shown in FIG. 3 to FIG. 5, the magnetic characteristic after the warm extrusion, particularly the $_IH_C$ was remarkably improved as compared with the phosphorus-added Mn—Al—C—P quaternary alloy and Mn—Al—C—Ni quaternary alloy by addition of $0.2\leqq Ni\leqq 2.5$ in the range of $0<P\leqq 0.6$. Namely, in respect to the $_IH_C$ value, the values were improved by 5% or more in the range of $0.2\leqq Ni\leqq 2.5$ as compared with the Ni-added quaternary alloy. Particularly in the range of $0.4\leqq Ni\leqq 2.0$, improvement of 15% or more is seen. On the other hand, in respect to the (BH)max, the increase was 5% due to addition to Ni of 0.2% by weight as compared with the P-added quaternary alloy. The maximum increase was 15% in the case of adding Ni in an amount of 0.8% by weight.

Once the amount of the Ni added exceeds 2.5% by weight, the Mn—Al—Ni phase ($\kappa$ phase) of soft, low saturated magnetization increases in the alloy which lowers the (BH)max. As apparent from the above-description, the effective addition amount of the Ni is $0.2\leqq Ni\leqq 2.5$.

When Ti was further added to the above-described Mn—Al—C—P—Ni pentad alloy, the (BH)max was further improved.

Figure 6:
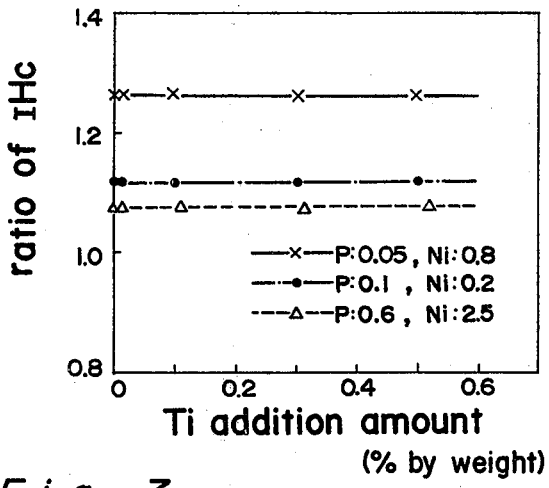
FIG. 6 and FIG. 7 are graphs each showing the relationship between the amount of titanium added and the $_IH_C$, (BH)max in a case where the titanium (Ti) has been added to an Mn—Al—C—P—Ni pentad alloy.
Figure 7:
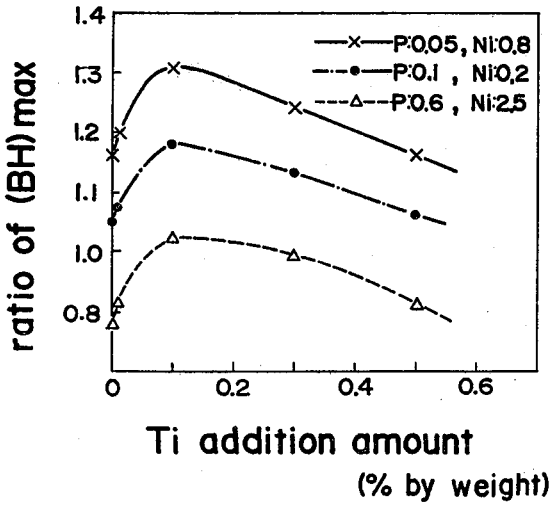

Experiments similar to those made in the P-added quaternary alloy were made in the Mn—Al—C—P—Ni—Ti hexad alloy. The cooling rate from 1100° C. to room temperature was 10° C. per second. The extrusion ratio was 5. The representative experimental results are shown in FIG. 6 and FIG. 7. FIG. 6 and FIG. 7 show the variations in the $_IH_C$, (BH)max, after the extrusion, with respect to the Ti addition amount. The values of the $_IH_C$, (BH)max are represented in ratio with respect to the $_IH_C$, (BH)max of the Mn—Al—C—Ni alloy (Ni=0.8%) made under the same conditions. From FIG. 6, the $_IH_C$ shows the almost the same value as the $_IH_C$ of the P—Ni-added hexad alloy in spite of the amount of Ti added. From FIG. 7, it was found out that the (BH)max considerably improved due to the Ti addition of $0.01\leqq Ti\leqq 0.5$. According to the observation of the texture of the heat treated alloy by a metallurgical microscope, the P—Ni—Ti-added hexad alloy became smaller in grain as compared with the Ni—P-added pentad alloy. The improvement in the (BH)max is supposed to be due to the refined grains through the Ti addition. Also, when the Ti addition amount exceeds 0.5% by weight, the (BH)max considerably lowered due to the decomposition of the $\tau$ phase of the ferromagnetic phase during the warm extrusion. Accordingly, the effective addition amount of the Ti is $0.01\leqq Ti\leqq 0.5$.

Iron (Fe), boron (B), copper (Cu) were added also singly or plurally in small amounts, respectively, to the P-added quaternary alloy, the P—Ni-added pentad alloy, and the P—Ni—Ti-added hexad alloy. It was found out by the examination thereof that the magnetic characteristics thereof were likely to be slightly improved as compared with those of the alloys to which Fe, B, Cu were not added (the P-added quaternary alloy, the P—Ni-added pentad alloy, the P—Ni—Ti-added hexad alloy) or were almost the same as those thereof.

The present invention will be described hereinafter with reference to the following examples 1 to 7.

EXAMPLE 1

A cylindrical alloy billet wherein the phosphorus of 0.1% by weight was added to a composition of manganese in an amount of 70.5% by weight, aluminum in an amount of 28.9% by weight, and the carbon of 0.6% by weight, and melting the alloy into a billet. The billet was homogenized for about one hour at 1100° C. and thereafter was air-cooled. The billet was extruded at an extrusion ratio of 6 at a temperature of 700° C. According to the measurements of the magnetic characteristic values in the direction of the preferred magnetization of the alloy after the extrusion, values of Br=5900 G, $_IH_C$=3600 Oe, (BH)max=6.0 MGOe were obtained. The $_IH_C$ was improved by 30%, the (BH)max was improved by 30% as compared with the magnetic characteristic value of the Mn—Al—C ternary alloy made under the same conditions as in the P-added quaternary alloy.

EXAMPLE 2

A cylindrical alloy billet wherein phosphorus in an amount of 0.05% by weight was added to the composition of the Mn 69.5% by weight, Al 30.0% by weight, and C 0.5% by weight, and the alloy was homogenized at 1100° C. for about two hours and thereafter air-cooled. The billet was extruded at an extrusion ratio of 9 at a temperature of 700° C. According to the measurements of the magnetic characteristic values in the direction of the preferred magnetization of the alloy after the extrusion, the values of Br=6200 G, $_IH_C$=4000 Oe, (BH)max=7.9 MGOe were obtained. The $_IH_C$ was improved by 60%, the (BH)max was improved by 30% as compared with the magnetic characteristic values of an Mn—Al—C ternary alloy made under the same conditions as in the P-added quaternary alloy.

EXAMPLE 3

A cylindrical alloy billet wherein phosphorus of 0.15% by weight was added to the composition of manganese of 70.8% by weight, aluminum of 28.5% by weight, and carbon of 0.7% by weight and the alloy was heat treated at a speed slower than that of the air-cooling operation after it was homogenized for one hour at 1100° C. The billet was extruded at an extrusion ratio of 6 at a temperature of 700° C. According to the measurements of the magnetic characteristic values in the direction of the preferred magnetization of the alloy after the extrusion, values of Br=5850 G, $_IH_C$=3500 Oe, (BH)max=5.8 MGOe were obtained. The $_IH_C$ was improved by 27%, the (BH)max was improved by 26% as compared with the magnetic characteristic values of the air-cooling of an Mn—Al—C ternary alloy.

EXAMPLE 4

A cylindrical alloy billet wherein phosphorus of 0.005% by weight was added to a composition of manganese of 69.8% by weight, aluminum of 29.8% by weight, carbon of 0.4% by weight, and the alloy was air-cooled after it had been homogenized for about one hour at 1100° C. The billet was extruded at an extrusion ratio of 6 at a temperature of 700° C. According to the measurements of the magnetic characteristic values in the preferred magnetization of the alloy after the extrusion, values of Br=5870 G, $_IH_C$=3200 Oe, (BH)max=5.1 MGOe were obtained. The $_IH_C$ was improved by 16% and the (BH)max was improved by 10% as compared with the magnetic characteristic values of an Mn—Al—C ternary alloy made under the same conditions as the above-described P-added quaternary alloy.

EXAMPLE 5

A cylindrical alloy billet with on outer diameter of 18 mm wherein phosphorus of 0.05% by weight, and nickel of 0.8% by weight were added to a composition of Mn of 70.0% by weight, Al of 29.5% by weight, and C of 0.5% by weight and by melting and casting the alloy. The billet was furnace-cooled after it had been homogenized at 1100° C. for about one hour. The billet was extruded at an extrusion ratio of 5 at a temperature of 700° C. According to the measurements of the magnetic characteristic values in the direction of the preferred magnetization of the alloy after the extrusion, values of Br=5900 G, $_IH_C$=3800 Oe, (BH)max=6.2 MGOe were obtained. The $_IH_C$ was improved by 25%, the (BH)max was improved by 15% as compared with the magnetic characteristic values of an Mn—Al—C—Ni quaternary alloy made under the same conditions as in a P—Ni-added pentad alloy.

EXAMPLE 6

A cylindrical alloy billet with an outer diameter of 18 mm was prepared wherein phosphorus in an amount of 0.1% by weight and nickel in an amount of 0.4% by weight were added to a composition of the Mn 69.5% by weight, the Al 29.4% by weight, the C 0.6% by weight. The alloy was melted and casted. The billet was air-cooled after it had been homogenized at 1100° C., and extruded at an extrusion ratio of 5 at a temperature of 700° C. According to the measurements of the magnetic characteristic values in the direction of preferred magnetization of the Ni—P-added pentad alloy after extrusion, values of Br=6000 G, $_IH_C$=3600 G, (BH)max=7.0 MGOe were obtained. The $_IH_C$ was improved by 20%, the (BH)max was improved by 10% as compared with the magnetic characteristic value of an Mn—Al—C—Ni quaternary alloy made under the same conditions as in P—Ni-added pentad alloy.

EXAMPLE 7

A cylindrical alloy billet wherein phosphorus of 0.07% by weight, Ni of 0.6% by weight, Ti of 0.1% by weight were added to a composition of Mn of 70.2% by weight, Al of 29.4% by weight, C of 0.4% by weight was made by melting, and casting the alloy and the alloy was air-cooled after it had been homogenized at 1100° C. for about one hour. The billet was extruded at an extrusion ratio of 5 at a temperature of 700° C. According to the measurements of the magnetic characteristic values in the direction of the preferred magnetization of the alloy after the extrusion, values of Br=6050 G, $_IH_C$=3850 G, (BH)max=7.4 MGOe were obtained. The Mn—Al—C—Ni quaternary alloy and the Mn—Al—C—Ni—Ti pentad alloy made under the same conditions as in the P—Ni—Ti-added hexad alloy were compared with each other. The $_IH_C$ was improved by 26% when compared with an Ni added quaternary alloy and an Ni—Ti-added pentad alloy. The (BH)max was improved by 12% in comparison with that of the Ni-added quaternary alloy and by 30% when compared with an Ni—Ti-added pentad alloy.

As described hereinabove, according to the present invention, phosphorus of X% by weight is added to a conventional Mn—Al—C alloy 100% wherein X has the value $0<X\leqq 0.6$ to increase the $_IH_C$ to 30% or more and the (BH)max to 10% or more as compared with a conventional Mn—Al—C alloy. Ni of Y% by weight is added under $0.2\leqq Y\leqq 2.5$ to the P-added quaternary alloy so that the P—Ni-added pentad alloy can further increase the $_IH_C$ of the P-added quaternary alloy and the (BH)max. Also, the Ti of Z% by weight wherein the value of Z is $0.01\leqq Z\leqq 0.5$ and is added to the P—Ni-added pentad alloy so that the P—Ni—Ti-added hexad alloy can increase the (BH)max of the P—Ni-added pentad alloy by 10% or more. Accordingly, the permanent magnet of the present invention is suitable for speakers, electric appliances, etc, thus resulting in magnets having higher industrial value.

What is claimed is:

1. In an anisotropic permanent magnet comprising an Mn—Al—C alloy comprising manganese of 68.0 to 73.0% by weight, carbon of (1/10Mn—6.6) to ($\frac{1}{3}$Mn—22.2)% by weight and the remainder aluminum, said alloy having been subjected to warm plastic deformation, said alloy being characterized in that said alloy contains phosphorus in an amount of X% by weight wherein the value of X is $0.005\leqq X\leqq 0.6$, all percentages being based on 100% of the total weight of manganese, aluminum and carbon.

2. An anisotropic permanent magnet according to claim 1, further containing nickel in an amount of 0.2 to 2.5% by weight based on 100% of the total weight of manganese, aluminum and carbon.

3. An anisotropic permanent magnet according to claim 2, further containing titanium in an amount of 0.01 to 0.5% by weight based on 100% of the total weight of manganese, aluminum and carbon.

4. An anisotropic permanent magnet according to claim 1 in which the amount of phosphorus added is at least 0.05%.

* * * * *